United States Patent [19]

Rausing et al.

[11] 4,140,235

[45] Feb. 20, 1979

[54] CLOSING ARRANGEMENT FOR PACKING CONTAINERS

[75] Inventors: Ruben A. Rausing, Rome, Italy; Ingvar E. Nilsson, Akarp, Sweden

[73] Assignee: Tetra Pak Developpement SA, Lausanne, Switzerland

[21] Appl. No.: 816,092

[22] Filed: Jul. 7, 1977

[30] Foreign Application Priority Data

Jul. 15, 1976 [CH] Switzerland ..... 9115/76

[51] Int. Cl.[2] ..... B65D 39/04; B65D 39/08; B65D 39/16

[52] U.S. Cl. ..... 215/305; 215/356; 220/307

[58] Field of Search ..... 215/329, 341, 354, 356, 215/364, 295, 335, 305, 274; 220/254, 304, 307, 208, 375, 291; 150/0.5; 222/563, 481

[56] References Cited

U.S. PATENT DOCUMENTS

| | | | |
|---|---|---|---|
| 589,505 | 9/1897 | Johnson | 215/356 |
| 2,772,037 | 11/1956 | Rieke | 220/304 |
| 3,245,569 | 4/1966 | Essich | 215/345 |
| 3,348,719 | 10/1967 | Rausing et al. | 215/354 |
| 3,415,405 | 12/1968 | Rausing et al. | 215/364 |
| 3,752,369 | 8/1973 | Robert | 222/481 |
| 3,854,618 | 12/1974 | Beghnini | 220/375 |

FOREIGN PATENT DOCUMENTS

| | | | |
|---|---|---|---|
| 1110076 | 6/1961 | Fed. Rep. of Germany | 215/356 |
| 1915356 | 10/1970 | Fed. Rep. of Germany | 215/365 |
| 1226087 | 7/1960 | France | 215/335 |
| 82672 | 2/1964 | France | 215/329 |

*Primary Examiner*—William T. Dixson, Jr.
*Assistant Examiner*—Allan N. Shoap
*Attorney, Agent, or Firm*—Burns, Doane, Swecker & Mathis

[57] ABSTRACT

A two-part closing arrangement for packing containers of plastic material comprises an internally threaded tubular body of a soft plastic secured to an inturned lip at the mouth of the container and into which is screwed a stopper-like cap also of plastic material and which is provided with a down-turned flange overhanging the mouth to be gripped by the user for applying and removing the cap.

4 Claims, 4 Drawing Figures

CLOSING ARRANGEMENT FOR PACKING CONTAINERS

Figure 1:
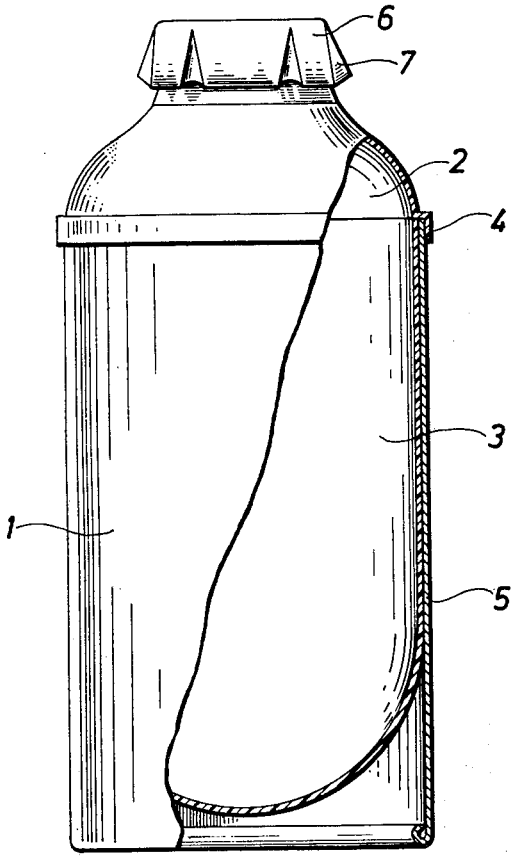

The present invention relates to a closing arrangement for packing containers of plastic material and of the type which has an opening comprising an inwardly directed lip arranged around the opening.

It is known in the technology of packaging that container impervious to gases can be made of plastic material which are suitable for the packing of pressurized contents, e.g. beer, refreshing beverages etc. A part of these known packing containers comprises a thin-walled container body of plastic material, which container body for the purpose of support is surrounded by a pressure-absorbing casing of paper or cardboard. The said casing encloses only the cylindrical shell part of the container, whilst the base part and top part of the container are dished or conical so that they should be better able to withstand the internal pressure emanating from the contents. It is also known that such packing containers can be closed with the help of a pull-up plastic stopper of polyethylene, which plastic stopper is provided with a bottom flange, which is adapted so, that when the stopper is pressed into the opening of the packing container, it is made to snap over an inwardly directed lip edge of the packing container. Closing devices of the type mentioned here have been used in connection with packing containers of polyvinyl chloride and have been found to function satisfactorily.

Since it was found that for environmental reasons polyvinyl chloride is not always suitable to be used as packing material, it was tried instead to find a plastic material with good imperviousness to gases, which could be used instead of polyvinyl chloride. It was found accordingly that acrylonitrile material, e.g. the material which is marketed under the trade name BAREX, has very good imperviousness characteristics, whilst at the same time the plastic material can be readily formed by deep-drawing. Since acrylonitrile material on combustion does not form toxic gases or in some other manner appears suspect from a point of view of protection of the environment, acrylonitrile has been allowed to replace polyvinyl chloride in the containers referred to here. One disadvantage of acrylonitrile materials however, is that they are not completely stable in their shape but tend to yield when subjected to compression which means that previously used cap arrangements cannot be used, since sealing surfaces which at the start where pressed against one another come apart owing to expansion of the acrylonitrile material.

A further disadvantage of the previously known packing containers is that they were provided with a pull-cap which on the one hand is relatively difficult to pull up and on the other hand is not reclosable.

The above-mentioned disadvantages are avoided with the help of the present invention which is characterized in that the closing arrangement consists of two parts, the first of which consists of a tubular body of a relatively soft plastic material, e.g. polyethylene, the outside of which comprises elements to ensure a tight connection of the said first part to the inwardly directed lip of the packing container and to fix the part to the said lip, and the inside of which has an internal thread, and that the second part comprises a stopperlike body of plastic material provided with an external thread, which in its upper part is provided with a flange and a gripping part to facilitate the handling of the said second part.

Figure 2:
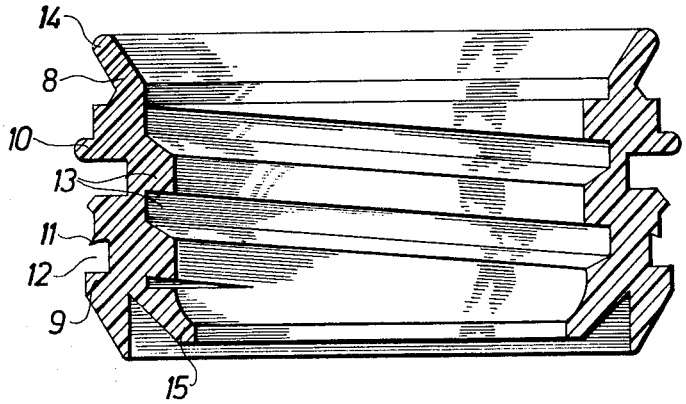
Figure 3:
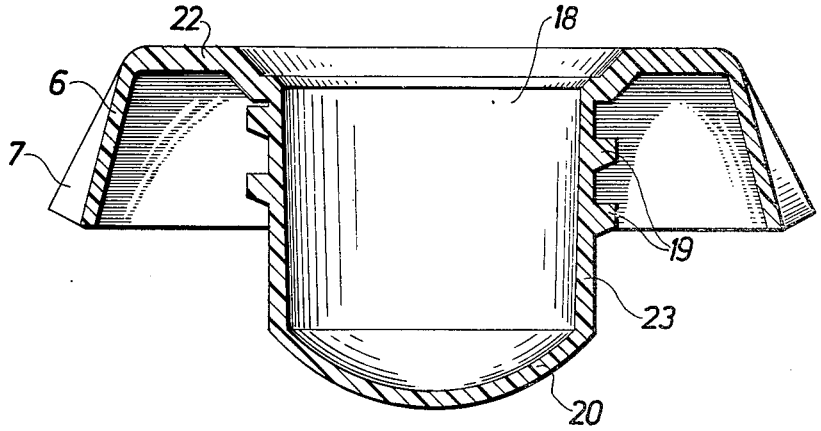
Figure 4:
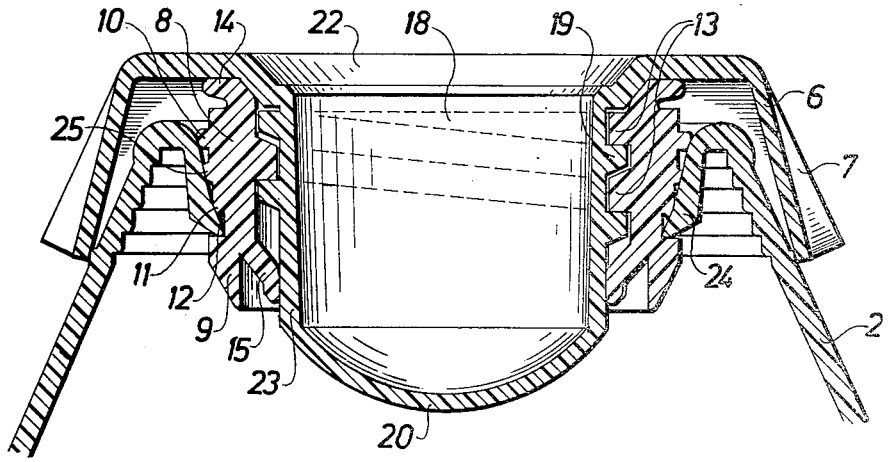

An embodiment of the invention will be described in the following with reference to the enclosed schematic drawing in which FIG. 1 shows the finished packing container, which is shown partly cut open, FIG. 2 shows a section of the tubular body, FIG. 3 shows a section of the stopperlike body, and FIG. 4 shows a section of the opening portion of the packing container with the closing arrangement fitted in the opening of the packing container.

The packing container shown in FIG. 1 is designated 1 and this partly cut open representation of a packing container consists of an inner thin plastic part 2, 3 which in the present case is assumed to be of acrylonitrile material, in particular the material which is marketed under trade name BAREX. The inner thin plastic container consists of an upper part 2 and a bottom part 3, which are joined together along a common flange 4. The bottom container part 3 consists of a cylindrical portion and a dished end part, the cylindrical portion being surrounded by an outer mechanically rigid casing 5 of paper or cardboard which is adapted so as to absorb the stresses which emanate from the contents which in the present case are assumed to be beer, refreshing beverages or any other contents which give off a gas, mostly carbon dioxide, which means that the inside of the packing container 1 will be under a pressure of between 1 and 4 bar depending on the type of the contents, temperature etc.

The packing container is provided furthermore with a closing arrangement indicated here and consisting of a cap 6 which is designed so that it has discontinuities, knurling or the like 7 so as to facilitate the handling of the cap when it is to be screwed in or out. It is assumed that the packing container shown in FIG. 1 is of the type which is provided with a screw cap which implies that the packing container can be reclosed easily and tightly after a part of the contents has been consumed.

After this general description of the packing container the closing arrangement itself will be described in closer detail, it being assumed that the closing arrangement can be used jointly with a packing container of the above-mentioned type, but it must also be underlined that the closing arrangement can also be used in connection with other types of packing containers, e.g. those which are blow-formed and do not consist of two parts welded together, and also in connection with packing containers which do not have the outer pressure-absorbing casing.

As mentioned in the foregoing, the closing arrangement itself consists of two parts, namely the tubular body shown in FIG. 2 and the stopperlike screw cap shown in FIG. 3, and in FIG. 4 these parts are shown joined together, with the tubular body also shown inserted in the mouth of the packing container.

The tubular body shown in FIG. 2 is provided with an internal thread 13 which in the realization shown here is a trapezoid thread whose thread profile is such that the underside of the thread is substantially perpendicular to the axis of symmetry of the threaded hole, whilst the upper side of the thread presents a relatively large slope against the axis of symmetry of the threaded hole. The lower part of the tubular body moreover has a projecting lip 15 which extends inwards towards the opening of the tubular part in such a manner that the hole which is defined by the periphery of the projecting lip 15 has a smaller diameter than the top diameter of the said thread 13.

The outside of the tubular body comprises an upper projecting flexible lip 14, which extends upwards and out from the opening of the tubular body in such a manner that the opening formed by the peripheral parts of the said lip has a greater diameter than the opening diameter of the tubular body. The outside of the tubular body comprises moreover a radially projecting flexible lip 10, a further flexible sealing lip 11 and a projecting flange 9.

The said tubular part 8 is manufactured appropriately from a soft plastic material, e.g. polyethylene, and an appropriate method of manufacture is injection moulding. It is also possible, however, to make the tubular body 8 of a material other than polyethylene and by a method other than injection moulding.

The stopperlike cap shown in FIG. 3 consists of an inner cylindrical part 23 the bottom part of which has a dome-shaped end wall 20. The cylindrical part 23 furthermore has outer threads 19 which are adapted so that they can co-operate with the aforementioned threads 13 on the tubular body 8. The tubular body 23 is joined in its upper part to a flange 22 which comprises a portion 6 bent downwards and wing-shaped parts 7 which are adapted so as to facilitate the handling of the stopper part.

The stopperlike cap 18 is manufactured from optional plastic material preferably by extrusion or moulding, but in the case described here it is assumed that the part 18 is manufactured from a material which is impervious to gas, e.g. an acrylonitrile material of the type which is marketed under trade name BAREX.

As is evident from FIG. 4, the tubular body is inserted in the opening of the bottle 2 by pressing the body 8 down into the said opening so that the inwardly directed lip 24 of the bottle or container is made to snap over the flange 9 directed outwards in such a manner that the bottom edge of the inwardly directed lip 24 will come to fit into the space 12 above the flange 9 on the tubular body 8, the edge of the said inwardly directed lip 24 being pressed against the upper side of the flange 9. When the tubular body is pressed into its position at the opening of the bottlelike container 2, the flange 10 directed radially outwards will be pressed against the upper part of the inwardly directed lip 24 of the container 2 with such a force that the lip will be somewhat deformed. Furthermore, the sealing lip 11 of the tubular body 8, shown facing outwards in FIG. 2, will be pressed against the inwardly directed lip 24 of the container 2, whereby it will be strongly deformed by bending whilst resting under strong contact pressure against the inwardly directed lip 24. The result of all these measures is that the tubular body 8 on the one hand will be fixed securely to the opening of the container 2, whilst on the other hand the fixing will take place in such a manner that pressurized gas, e.g. carbon dioxide or oxygen, cannot leak out between the inwardly directed lip 24 and the outside of the tubular body. For the further strengthening of the seal it is possible to provide the tubular body 8 with further sealing tongues 25 which are pressed radially against the inwardly directed lip 24.

The opening of the tubular body 8 is closed with the help of the stopperlike cap 18, in that the same is introduced into the tubular body and is screwed to complete tightness between the tubular body 8 and the stopperlike cap part 18. This tightning is achieved, inter alia, because the cylindrical part 23 of the stopperlike cap 18, when it is screwed in, is pressed against the flange 15, whereby the hole defined by the flange 15 is enlarged owing to the flange 15 being folded downwards whilst resting tightly against the outside of the stopperlike cap 18. Moreover, a seal is obtained owing to the upper flange 22 of the cap pressing with its underside against the upper lip 14 of the tubular body 8, which is deformed by the pressure, and folds back outwards whilst resting tightly against the underside of the flange 22 of the cap. As the cap 18 is manufactured from acrylonitrile material of the type which is marketed under trade name BAREX, the cap has very good imperviousness to gas, which means that any leakage of carbon dioxide from a package of e.g. beer or refreshing beverage will be very low at the same time as any oxygen diffusion into the package will likewise be low.

One advatage of the arrangement in accordance with the invention is that the tubular body 8 and the stopperlike cap 18 can be combined with one another to a uniform closing device, which, when the bottlelike container 2 has been filled with the intended contents, is pressed into the opening of the container 2 so that the tubular body 8 is fitted in the manner described above into this opening to form a seal. On filling the bottle-like containers 2 it is thus not necessary to screw the stopper-like cap in in a special operation, but the only operation that has to be carried out consists in pressing the tubular body provided with stopper cap into the opening of the container.

It has been found that a closing arrangement in accordance with the invention is on the one hand relatively simple to manufacture and on the other hand provides a good seal owing to the cap 18 and the packing container, both assumed to be made of acrylonitrile material, not being directly combined with one another but being fixed in a sealing manner to one another with the help of the tubular element 8 which is manufactured from a plastic material which is appreciably softer and more resilient than the acrylonitrile material.

We claim:

1. A closure apparatus for a plastic container which has an upwardly opening mouth surrounded by an inwardly and downwardly directed lip, comprising:

a tubular body of a relatively soft plastic material, adapted to be press-fitted into the mouth of the container, said tubular body having:

an outer annular indentation for forming a gas-tight seal with an inner circumferential edge of the lip of the container and for maintaining the tubular body in position in the mouth of the container;

an internal thread;

a radially outwardly and upwardly extending annular flange on an upper edge of the tubular body; and, a lower, radially inwardly and downwardly extending annular flange located below the internal thread; and a stopper body of a relatively hard plastic material having:

a dished lower end;

a substantially cylindrical central portion having an external thread for engaging the internal thread of the tubular body; and, a gripping member extending, first, radially outwardly from the cylindrical portion above the external thread, and then downwardly, for facilitating insertion and removal of the stopper body;

wherein the cylindrical portion of the stopper body has an outside diameter larger than the inner diameter of the lower flange of the tubular body;

whereby a gas-tight seal is formed below the threads when the stopper member is located in the tubular body and wherein the outwardly extending portion of the gripping member is adapted to downwardly compress the upper flange of the tubular member to form a gas-tight seal above the threads when the stopper member is completely screwed into the tubular body.

2. The closure apparatus in accordance with claim 1 wherein the inside of the tubular body comprises a thread-free area at its lower part, and the indentation on the outside of the tubular body is located at that part of the tubular body which has the said thread-free area.

3. The closure apparatus in accordance with claim 2, wherein the tubular body and stopper body are combined by being screwed together, and are pressed into the mouth of the packing container so that the inwardly directed lip of the container is made to snap into place in the annular indentation in the tubular body.

4. The closure apparatus in accordance with claim 1, wherein the tubular body is manufactured from a softer, elastic plastic such as polyethylene, and the stopper body is manufactured from a harder plastic, in particular acrylonitrile.

* * * * *